US008800826B2

(12) United States Patent
Forbis et al.

(10) Patent No.: US 8,800,826 B2
(45) Date of Patent: Aug. 12, 2014

(54) SELF-VENTING SPOUT

(75) Inventors: Charlie L. Forbis, Quapaw, OK (US); Grant Kernan, Monkey Island, OK (US)

(73) Assignee: Scepter Manufacturing, LLC, Miami, OK (US)

( * ) Notice: Subject to any disclaimer, the term of this patent is extended or adjusted under 35 U.S.C. 154(b) by 59 days.

(21) Appl. No.: 13/551,371

(22) Filed: Jul. 17, 2012

(65) Prior Publication Data

US 2014/0021222 A1 Jan. 23, 2014

(51) Int. Cl.
*B67B 1/00* (2006.01)

(52) U.S. Cl.
USPC ..... 222/484; 222/153.14; 222/465.1; 222/567

(58) Field of Classification Search
USPC ..... 222/484, 166, 153.01, 465.1, 479, 559, 222/567
See application file for complete search history.

(56) References Cited

U.S. PATENT DOCUMENTS

| | | | | | |
|---|---|---|---|---|---|
| 2,445,130 | A * | 7/1948 | Turner | ..... | 141/290 |
| 2,488,236 | A * | 11/1949 | Potts | ..... | 141/293 |
| 2,980,302 | A * | 4/1961 | Rasmussen | ..... | 222/453 |
| 3,606,096 | A * | 9/1971 | Campbell | ..... | 222/479 |
| 4,903,742 | A * | 2/1990 | Gagnon | ..... | 141/353 |
| 4,930,689 | A * | 6/1990 | Stumpf | ..... | 222/487 |
| 5,107,909 | A * | 4/1992 | Donovan | ..... | 141/296 |
| 6,155,464 | A * | 12/2000 | Vachon | ..... | 222/484 |
| 6,227,419 | B1 | 5/2001 | Raboin | | |
| 6,397,902 | B1 | 6/2002 | Murphy | | |
| 6,435,380 | B1 | 8/2002 | Raboin | | |
| 6,575,333 | B1 | 6/2003 | Raboin | | |
| 6,581,851 | B1 | 6/2003 | Murphy | | |
| 6,968,875 | B2 | 11/2005 | Nielsen | | |
| 7,089,975 | B2 | 8/2006 | Chrisco et al. | | |
| 7,128,108 | B2 | 10/2006 | Nielsen | | |
| 8,038,035 | B2 * | 10/2011 | Forbis | ..... | 222/153.14 |
| 8,403,185 | B2 * | 3/2013 | Vachon | ..... | 222/484 |
| 8,561,858 | B2 * | 10/2013 | Vachon | ..... | 222/484 |
| 2004/0035895 | A1 * | 2/2004 | Schliemann et al. | ..... | 222/484 |
| 2010/0308085 | A1 * | 12/2010 | Vachon | ..... | 222/484 |

FOREIGN PATENT DOCUMENTS

| | | |
|---|---|---|
| DE | 2514278 | 7/1976 |

* cited by examiner

*Primary Examiner* — Paul R Durand
*Assistant Examiner* — Donnell Long
(74) *Attorney, Agent, or Firm* — Hovey Williams LLP

(57) ABSTRACT

A normally-closed pour spout is operable to pour fluid from a container to a receptacle. The normally-closed pour spout includes a fluid conduit and a valve. The fluid conduit has proximal and distal ends, with the proximal end being fluidly connectable to the container and the distal end being configured for fluid association with the receptacle. The fluid conduit forms a passageway configured to pass fluid therethrough and fluidly communicate with the container and the receptacle. The valve is operably assembled with the fluid conduit so that the valve controls fluid flow through the passageway.

26 Claims, 7 Drawing Sheets

SELF-VENTING SPOUT

BACKGROUND

1. Field

The present invention relates generally to spouts for containers used to contain and dispense fluid. More specifically, embodiments of the present invention concern a pour spout that is normally locked in a closed position to prevent inadvertent dispensing of fluid.

2. Discussion of Prior Art

Conventional portable fuel containers include a spout for dispensing fuel from the container. Such containers are commonly used for conveniently supplying fuel to a wide range of powered equipment such as automobiles, boats, tractors, motorcycles, all-terrain vehicles, generators, and mowers. Furthermore, prior art containers are also configured to contain and dispense a variety of liquids such as water, oil-based liquids, glycol or other liquids for use in powered equipment or other applications. Those ordinarily skilled in the art will appreciate that many prior art fuel nozzles, such as those connected to fueling pumps by a fuel hose, include a valve for quickly controlling flow through the nozzle. The nozzle typically includes a housing and a valve-actuating lever, where the housing presents a grasping surface, and the lever is pivotally attached to the housing adjacent the surface to selectively open the valve. In this manner, a user can hold and position the nozzle, e.g., for dispensing fuel from the container into a refillable fuel reservoir, while simultaneously holding and depressing the lever with one hand to dispense fuel.

Conventional spouted containers suffer from various deficiencies. For example, prior art spouted containers fail to safely and conveniently vent during use. Spouted containers often present an opening spaced oppositely from the spout for allowing air into the container. Such vents are prone to fluid leakage and require opening and closing steps separate from opening and closing of the container spout. Another problem associated with prior art fuel spouts is that they tend to dispense fuel in a turbulent stream that can result in fuel spillage. Yet further, prior art spouts have been provided with safety valves for reducing the risk of accidental opening or tampering. However, such spouts tend to have unwieldy, complicated designs that are difficult to operate and expensive to manufacture.

SUMMARY

The following brief summary is provided to indicate the nature of the subject matter disclosed herein. While certain aspects of the present invention are described below, the summary is not intended to limit the scope of the present invention.

Embodiments of the present invention provide a self-venting spout that does not suffer from the problems and limitations of the prior art spouts set forth above.

A first aspect of the present invention concerns a normally-closed pour spout operable to pour fluid from a container to a receptacle. The normally-closed pour spout broadly includes a fluid conduit, a valve, and a retention device. The fluid conduit has proximal and distal ends, with the proximal end being fluidly connectable to the container and the distal end being configured for fluid association with the receptacle. The fluid conduit forms a passageway configured to pass fluid therethrough and fluidly communicates with the container and receptacle. The fluid conduit defines a valve seat spaced along the passageway from the distal end. The valve is operably assembled with the fluid conduit so that the valve controls fluid flow through the passageway. The valve includes a valve element shiftable between a valve closed position, in which the valve element engages the valve seat to occlude the passageway, and a valve open position, in which the valve element is spaced from the valve seat to permit flow through the passageway. The valve element shifts in a first direction from the closed position to the open position and in an opposite second direction from the open position to the closed position. The valve element is shiftable in the second direction beyond the closed position to disassemble the valve from the fluid conduit. The retention device restricts shifting of the valve element in the second direction beyond the closed position to thereby prevent disassembly of the valve from the fluid conduit.

A second aspect of the present invention concerns a normally-closed pour spout operable to pour fluid from a container to a receptacle. The normally-closed pour spout broadly includes a fluid conduit and a valve. The fluid conduit has proximal and distal ends, with the proximal end being fluidly connectable to the container and the distal end being configured for fluid association with the receptacle. The fluid conduit forms an axially extending passageway configured to pass fluid therethrough and fluidly communicate with the container and receptacle. The valve is operably assembled with the fluid conduit so that the valve controls fluid flow through the passageway. The valve includes a valve body slidably coupled to the fluid conduit for axial movement along the passageway between a valve open condition, in which fluid is permitted to flow through the passageway, and a valve closed condition, in which the passageway is occluded. The valve includes a catch shiftable into and out of a locking position, in which the catch prevents sliding of the valve body out of the closed condition. The valve includes a retainer configured to releasably retain the catch out of the locking position so as to permit sliding of the valve body out of the closed condition. The catch is automatically released by the retainer when the valve body is in the valve open condition so that the catch is permitted to return to the locking position.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
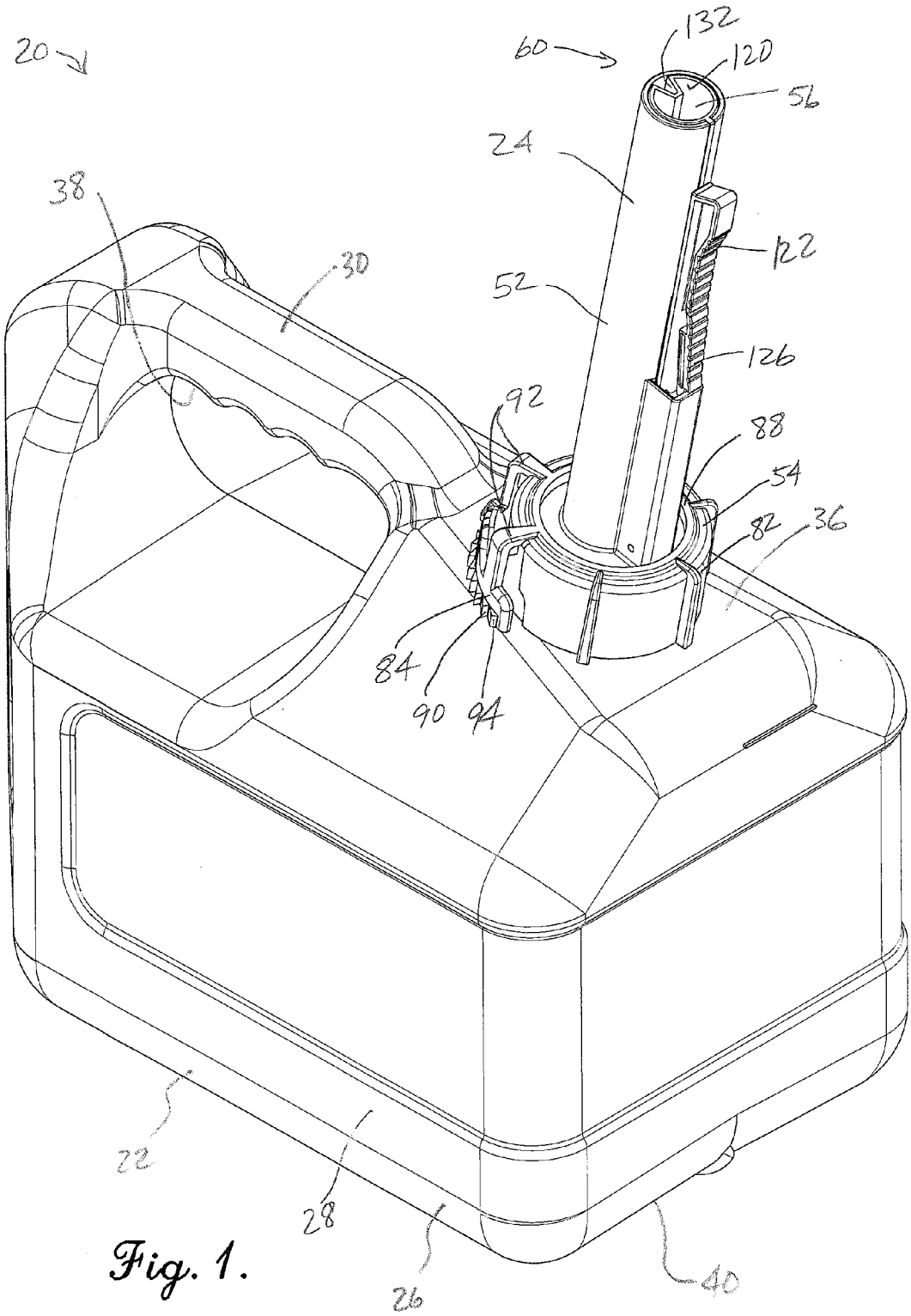
FIG. 1 is a perspective view of a spouted container constructed in accordance with a preferred embodiment of the present invention.
Figure 2:
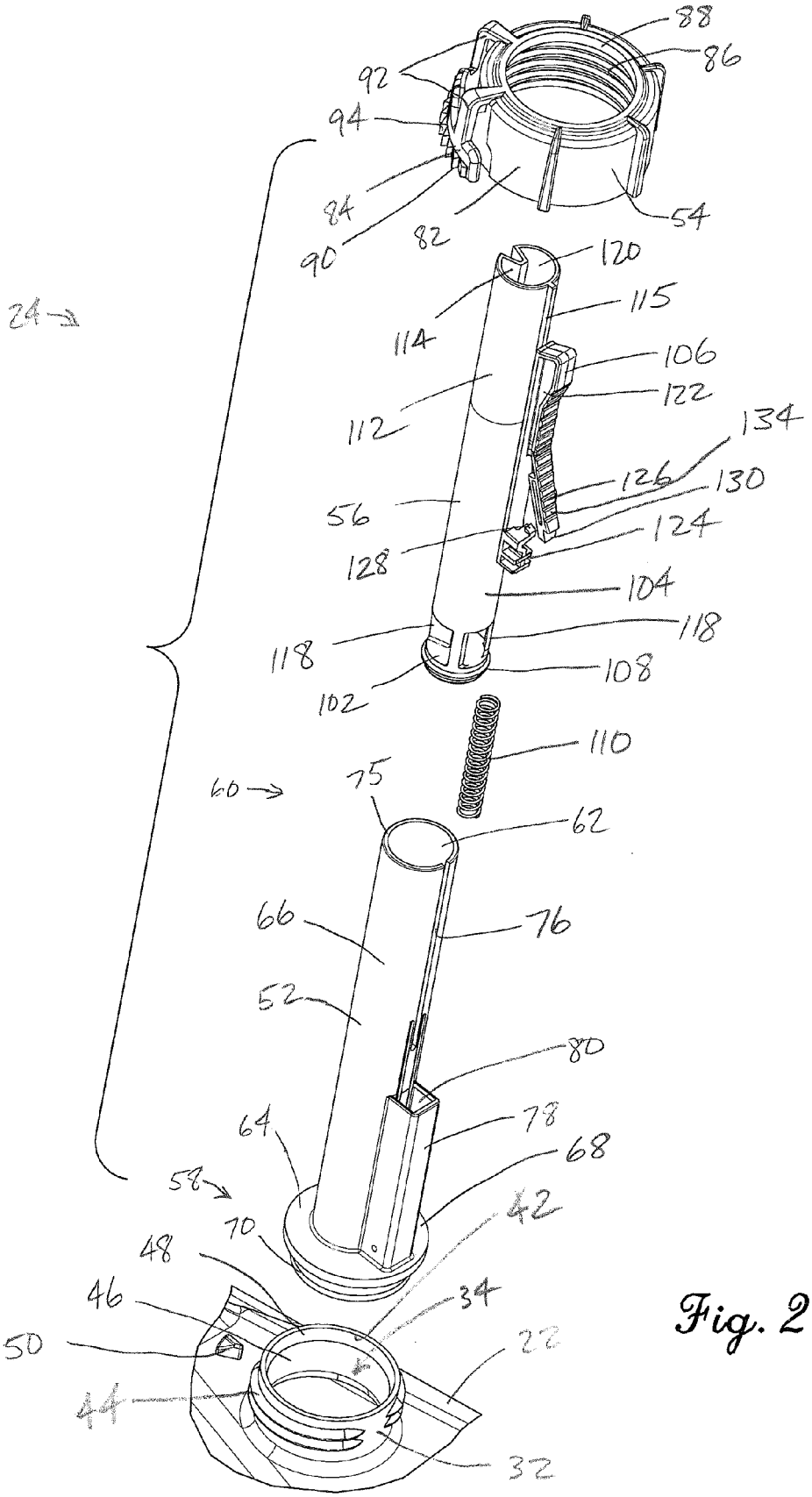
FIG. 2 is an exploded fragmentary perspective view of the spouted container shown in FIG. 1, showing a container and a pour spout, with the illustrated pour spout including a conduit, a collar for securing the conduit onto the container, and a valve, and with the valve including a valve disc, a tubular valve body, a valve locator, an o-ring, and a spring.
Figure 3:
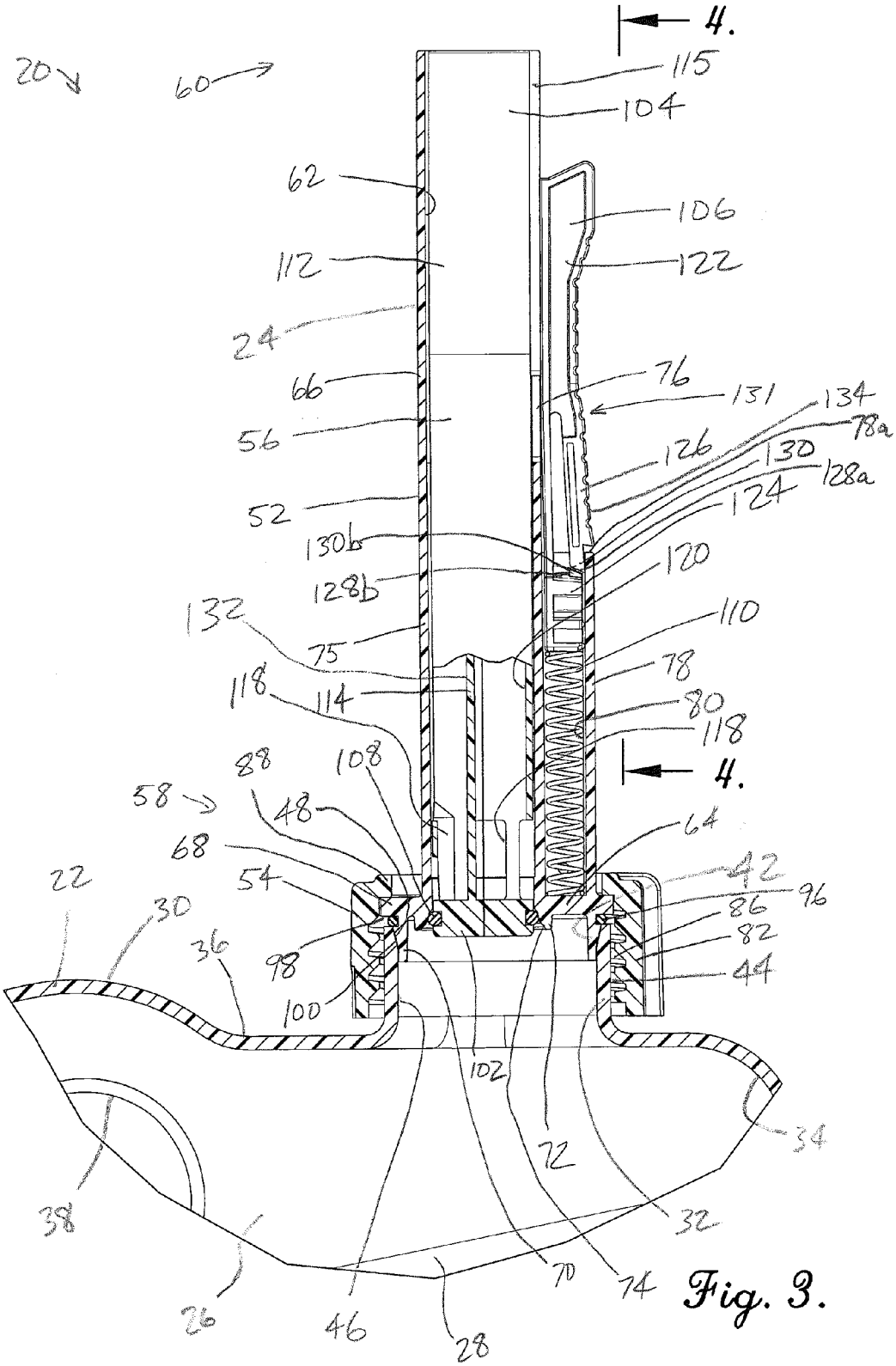
Figure 4:
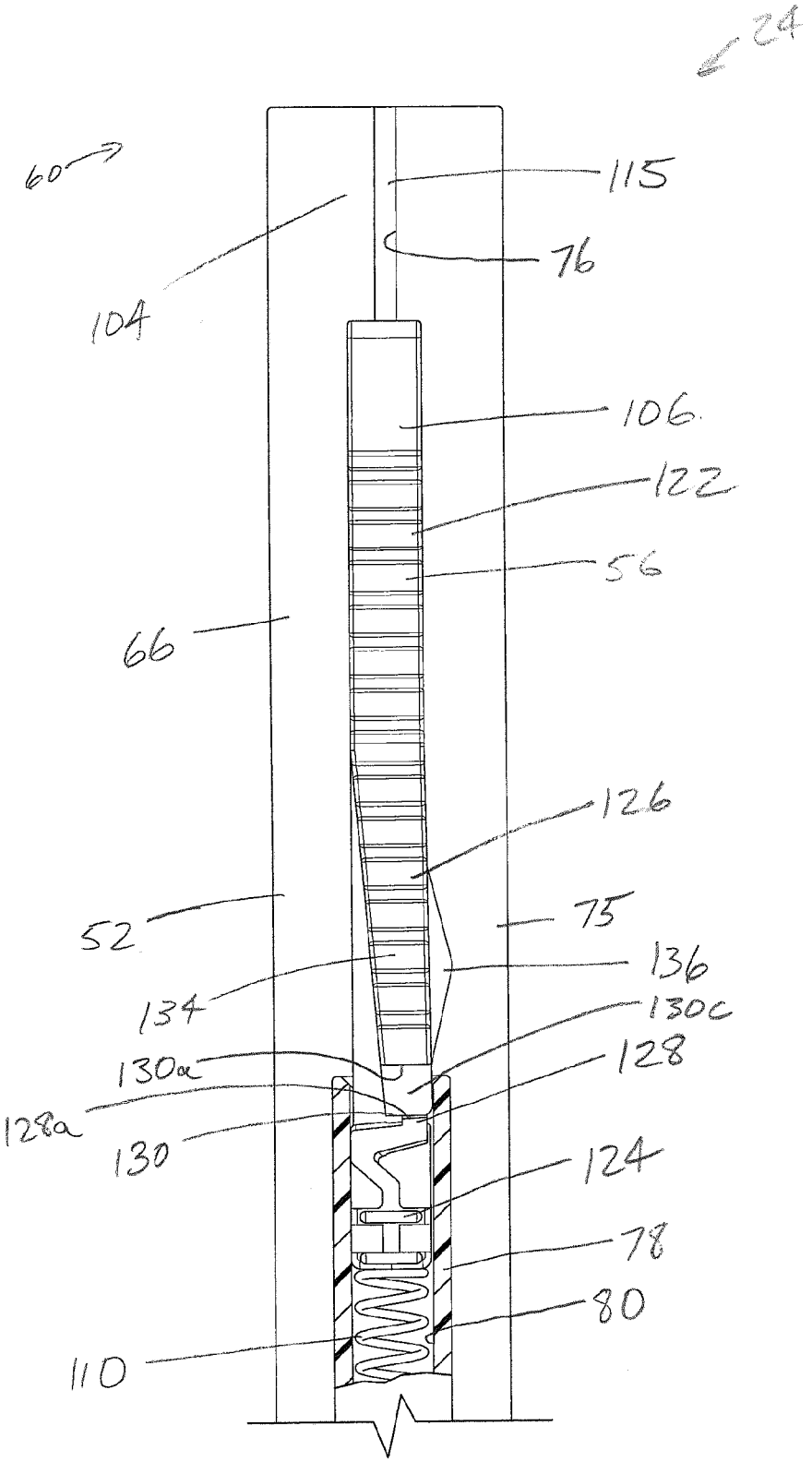
Figure 5:
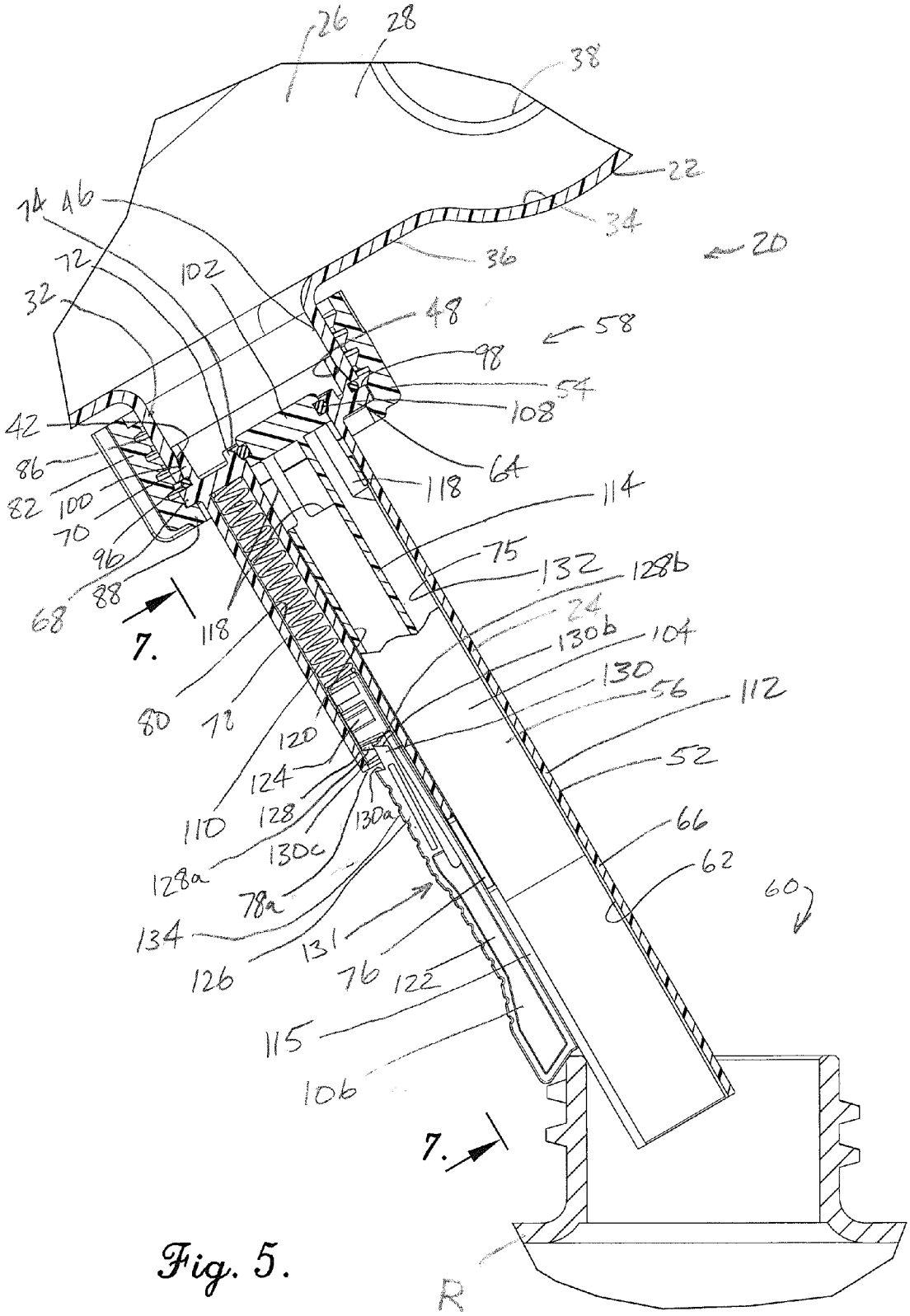
Figure 6:
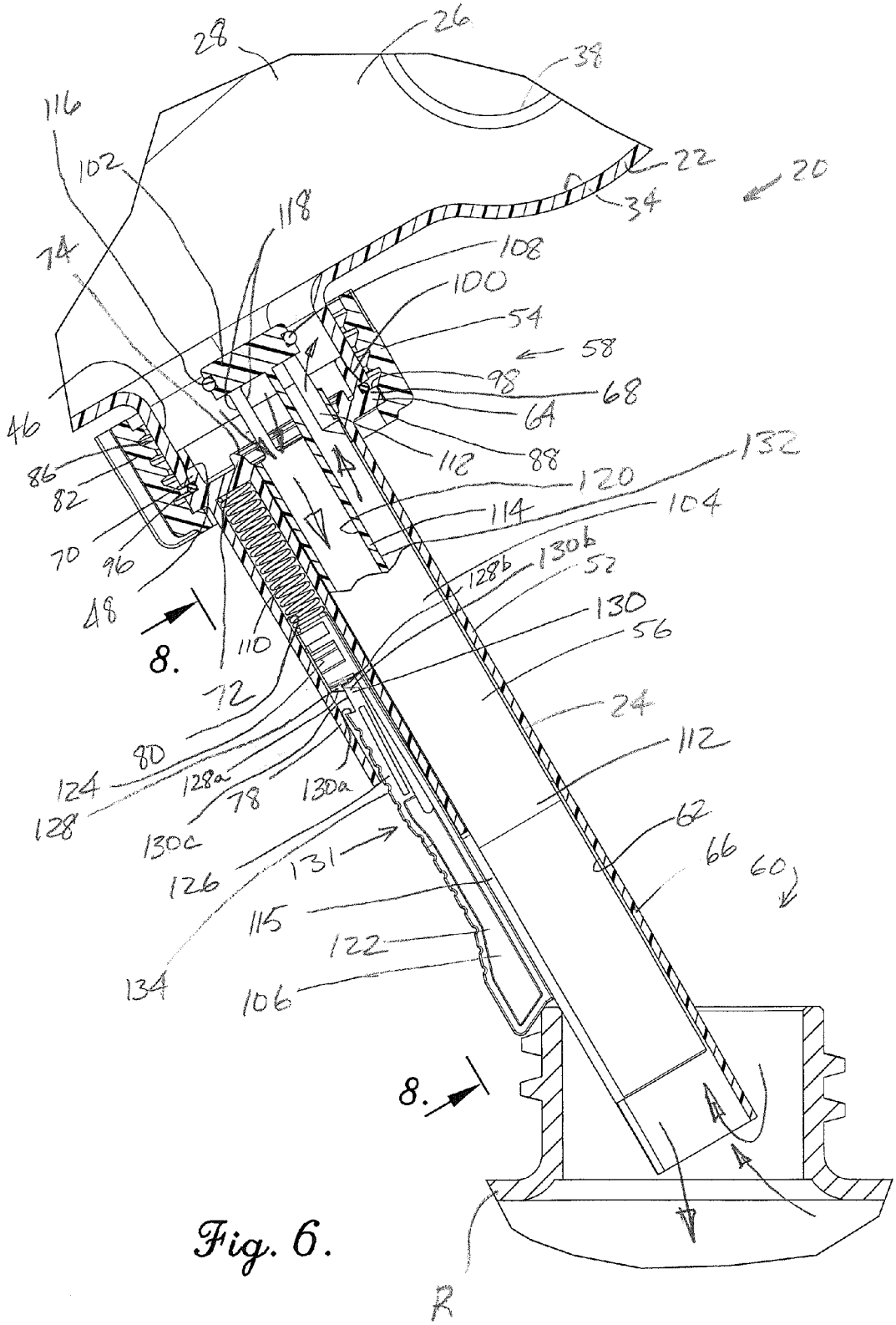
Figure 7:
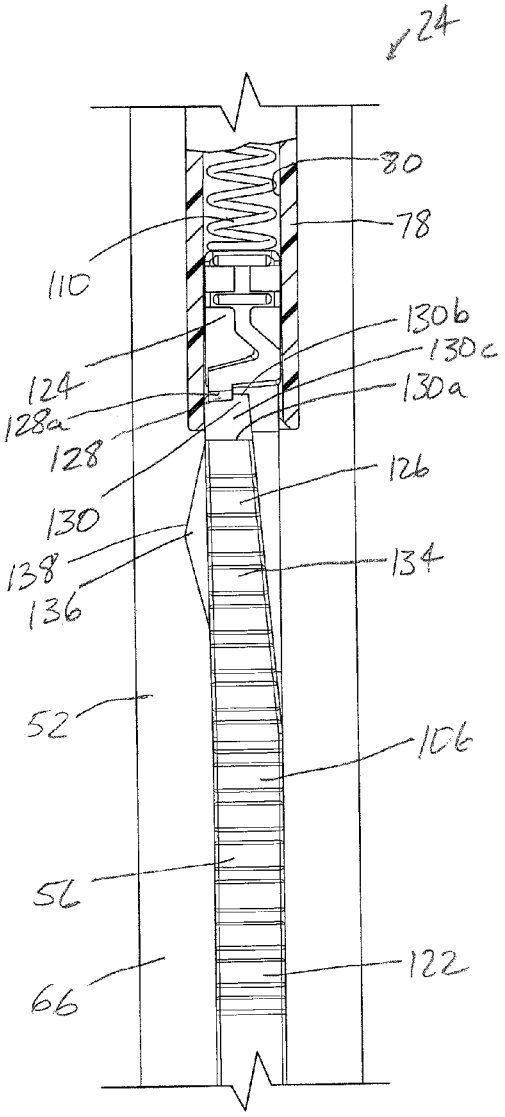
Figure 8:
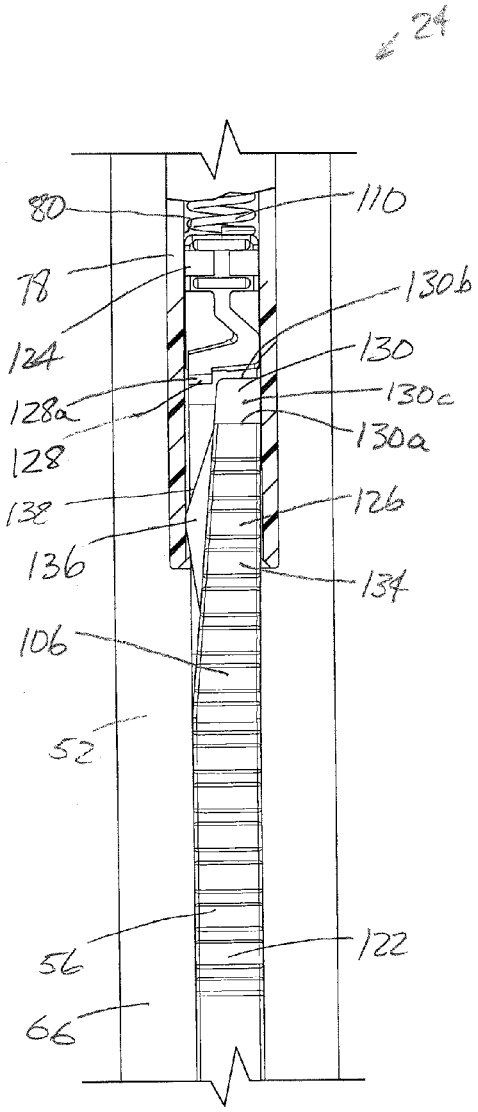

FIG. 3 is a fragmentary cross section of the spouted container shown in FIGS. 1 and 2, with the valve being received by a passageway of the conduit so that the valve locator and spring are positioned within a chamber adjacent the passageway, showing the valve in a closed valve position and the valve body in a closed valve condition, and with a catch and retainer of the valve locator being in a released condition so that the catch and retainer are out of latching interengagement and the catch is in a locked position with a shoulder presented by the conduit;

FIG. 4 is a fragmentary cross section of the pour spout taken along line 4-4 in FIG. 3, with the catch and retainer of the valve locator being in the released condition where the catch and retainer are shifted out of latching interengagement;

FIG. 5 is a fragmentary cross section of the spouted container shown in FIGS. 1-4, showing a distal end of the valve locator engaged with the neck of a receptacle so that the spouted container is oriented to pour fluid into the receptacle, with the catch and retainer of the valve locator being in latching interengagement in a retained condition so that the catch is unlocked from the conduit shoulder in an unlocked position and permits opening of the valve;

FIG. 6 is a fragmentary cross section of the spouted container similar to FIG. 5, but showing the valve shifted proximally toward an open valve position to allow fluid to be poured from the spouted container into the receptacle, with the catch and retainer being in the retained condition;

FIG. 7 is a fragmentary cross section of the pour spout shown in FIGS. 1-6, showing the valve locator in the retained condition, with the catch being engaged with the conduit shoulder in a locked position and the valve in the closed valve position; and FIG. 8 is a fragmentary cross section of the pour spout similar to FIG. 7, but showing the valve shifted proximally into the open valve position, with a trip surface of the catch engaging a guide wall of the conduit to shift the catch laterally and out of latching interengagement with the retainer so that the catch and retainer are in the released condition, with the catch being biased to automatically return to the locked position once the valve returns to the closed valve position.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIGS. 1-3, a spouted container 20 constructed in accordance with a preferred embodiment of the present invention is configured for containing fuel therein and for efficiently transferring the stored fuel to another receptacle R (see FIG. 5). While the illustrated container 20 is particularly designed for containing fuels, such as gasoline or diesel fuel, the principles of the present invention are equally applicable where the illustrated container 20 is configured to hold other types of fluids, such as water, petroleum-based liquids, other naturally occurring liquids, or synthetic liquids. Furthermore, it is consistent with the principles of the present invention where the container 20 generally stores fluids securely so as to prevent inadvertent spillage and prevent tampering of contained fluid. The spouted container 20 broadly includes a storage container 22 and a self-venting pour spout 24.

The storage container 22 is operable to store fluids therein and is configured to receive the pour spout 24 as will be discussed in greater detail. The storage container 22 broadly includes a wall 26 that forms a container body 28, a handle 30, and a neck 32. The wall 26 also defines an internal chamber 34 that receives the contained fluid. The body 28 preferably presents an approximately parallelepiped shape. However, consistent with the principles of the present invention, the body 28 could be alternatively shaped, e.g., the body 28 could be barrel-shaped. The handle 30 and neck 32 are preferably spaced along an upper margin 36 of the body 28 and preferably formed integrally with the body 28. However, it is also within the ambit of the present invention where the handle 30 or neck 32 are constructed separately from the container body 28, with the assembly providing a suitable container for storing fluids.

Again, the handle 30 is integrally formed with the body 28 to present an opening 38 that is configured to receive a user's hand in the usual manner. The handle 30 extends generally parallel to a base 40 of the container 22, with the neck 32 being preferably spaced forwardly of the handle 30, i.e., adjacent a forward end of the container 22. However, the handle 30 and neck 32 could be alternatively arranged relative to the body 28 consistent with the principles of the present invention.

The neck 32 is spaced forwardly of the handle 30 and presents a substantially round mouth 42. The neck 32 is preferably cylindrical and presents a threaded outer surface 44 and an inner surface 46. The inner surface 46 includes a beveled portion 48 that receives a portion of the pour spout 24 in sealing engagement, with another portion of the pour spout 24 being threaded onto the threaded outer surface 44 to secure the spout 24 onto the container 22. The mouth 42 preferably serves as the only opening that permits fluid communication between the chamber 34 and the ambient environment. However, the principles of the present invention are applicable where the container 22 presents more than one opening that fluidly communicates with the chamber 34, e.g., where the container 22 presents a vent opening spaced apart from the mouth 42. The wall 26 also forms a locking projection 50 that is preferably spaced between the neck 32 and the handle 30. The locking projection 50 engages a portion of the pour spout 24 to secure the pour spout 24, as will be discussed further.

Again, the container 22 is preferably integrally formed of a durable and fluid-tight material. Preferably, the container 22 is molded from a polymer resin material. However, it is consistent with the principles of the present invention where the container is constructed from materials other than plastic, such as steel or other metals, or is made by manufacturing methods other than molding.

Turning to FIGS. 1-6, the pour spout 24 is configured for efficiently and safely transferring fluid into and out of the chamber 34. In particular, the pour spout 24 permits fuel to be dispensed from the chamber 34 into the receptacle R while allowing air to simultaneously be vented into the chamber 34 and while restricting inadvertent spillage. Furthermore, the pour spout 24 can be selectively opened and closed by a mechanism that includes a safety lock for preventing inadvertent opening of the spout 24 and, consequently, restricting spillage. The pour spout 24 broadly includes a fluid conduit 52, a collar 54 for securing the conduit onto the neck 32, and a locking valve 56.

Turning to FIGS. 5-6, the conduit 52 is preferably unitary and presents proximal and distal ends 58,60 and a passageway 62 extending from one end to the other. The illustrated conduit 52 preferably includes a base section 64 and a nozzle section 66 that are integrally molded with one another. Preferably, the base section 64 is unitary and includes a disc-like flange 68, an outer beveled sleeve 70 configured to engage the mouth 42, and an inner rib 72. The conduit 52 also presents a beveled surface 74 that extends along the inner rib 72 to provide a valve seat.

The nozzle section 66 includes an annular wall 75 that extends axially to present an axial bore that defines part of the passageway 62. The annular wall 75 preferably presents a slot 76 that extends axially from the distal end 60 to a location between the ends 58,60. The nozzle section 66 also preferably includes a guide wall 78 that extends axially along and is integrally formed with the annular wall 75. As will be described further, the guide wall 78 presents a locking shoulder 78*a* that is operable to engage the valve 56. Also, the illustrated walls 75,78 cooperatively define a chamber 80 that receives part of the valve 56. However, it is also within the ambit of the present invention where the nozzle section 66 is alternatively configured. For instance, the nozzle section 66 could be devoid of the guide wall 78. Yet further, the conduit 52 could have an alternative construction without departing from the scope of the present application.

Turning again to FIGS. 1-3, the collar 54 includes a threaded sleeve 82 and a locking tab 84. The threaded sleeve 82 presents internal threads 86 and a radially innermost annular ledge 88. The locking tab 84 includes a body 90 and arms 92 that interconnect the body 90 and sleeve 82 so that a small annular gap normally exists between the sleeve 82 and body 90. The body 90 presents radially outermost teeth 94 for engaging the locking projection 50.

The conduit 52 is preferably secured to the neck 32 by positioning the beveled sleeve 70 within the mouth 42 and in sealing contact with the beveled surface portion 48. Furthermore, an end of the neck 32 is located adjacent a lower surface of flange 68, with an o-ring 96 located in an o-ring gland 98 of the conduit 52. The beveled sleeve 70 is configured to yield slightly so that a tight seal is formed between the beveled surface portion 48 and an outer beveled surface 100 of the sleeve 70.

When threaded onto the neck 32, the ledge 88 rotatably engages an upper surface of the flange 68 to urge the beveled sleeve 70 into the mouth 42. The collar 54 is threaded onto the threaded outer surface 44 until the collar 54 forces the o-ring 96 into engagement with the neck 32. Thus, the o-ring 96 is captured between the end of the neck 32 and the lower surface of the flange 68. It will be appreciated that the collar 54 can be partly threaded onto the neck 32 so that the conduit 52 can be freely rotated relative to the neck 32 (e.g., to position the spout relative to the container 22 prior to dispensing fluid into the receptacle R). The conduit 52 is preferably frictionally prevented from rotating relative to the neck 32 when the collar 54 is fully tightened. In this manner, the illustrated construction helps to maintain proper positioning of the spout 24 so that the vent passage presented by the valve 56 remains positioned along a top margin of the pour spout 24 while pouring fluid with the spout 24. However, the principles of the present invention are applicable where the conduit 52 is permitted to rotate while maintaining sealing engagement between the neck 32 and conduit 52.

As the collar 54 is rotated clockwise onto the neck 32, the locking tab 84 engages the locking projection 50 along teeth 94. Removal of the collar 54 by counterclockwise rotation requires the user to depress the locking tab 84 in order to space the tab 84 apart from the locking projection 50. The collar 54 is removable by depressing the locking tab 84 and simultaneously rotating the collar 54. Thus, the locking tab 84 serves to prevent inadvertent removal of the pour spout 24.

With the conduit 52 positioned in sealing engagement with the neck 32, the illustrated pour spout 24 is operable to dispense fluid from the container 22. Simultaneously, the pour spout 24 is operable to allow air to be vented into the container 22. While the conduit 52 is preferably attached directly to the neck 32 by the collar 54, it is also consistent with the principles of the present invention where the conduit 52 is not directly attached to the container 22. For example, the conduit 52 and container 22 could be fluidly interconnected by a hose or tubing.

The conduit 52 and collar 54 are preferably molded from a durable polymer resin material. However, it is consistent with the principles of the present invention where the conduit 52 and collar 54 are constructed from materials other than plastic, such as steel or other metals, or is made by manufacturing methods other than molding.

Turning to FIGS. 2-4, the spout 24 again preferably includes the locking valve 56. The illustrated valve 56 preferably includes a valve disc 102, a tubular body 104, and a valve locator 106. The spout 24 also preferably includes an o-ring 108 and a spring 110. The tubular body 104 preferably includes an annular wall 112 and a vent wall 114 that extends along the length of the annular wall 112 and projects radially inwardly therefrom. The tubular body 104 also preferably includes a longitudinal rib 115 that extends axially and projects radially outwardly from the annular wall 112. When viewed from the end of the spout 24, the vent wall 114 preferably has a generally V-shaped profile that is substantially continuous along the length of the spout 24. However, the principles of the present invention are applicable where the vent wall 114 and/or the annular wall 112 has an alternative shape. Furthermore, for some aspects of the present invention, the spout 24 could have an alternative container venting mechanism.

The illustrated valve disc 102 preferably comprises a piston with a generally circular cross-sectional shape. The disc 102 is operable to slide axially along an axis of the passageway 62. The valve disc 102 preferably presents a valve diameter dimension that is less than a minimum diameter dimension of the passageway 62, with the minimum diameter dimension being preferably located adjacent the proximal end of the conduit 52. As will be discussed, the valve disc 102 is sized to permit valve removal from the conduit 52 while allowing the valve 56 to occlude the passageway 62. In the illustrated embodiment, the minimum passageway diameter dimension preferably ranges from about three tenths (0.3) of an inch to about two (2.0) inches and, more preferably, is about seven tenths (0.7) of an inch. Also, the difference between the minimum passageway diameter dimension and the valve diameter dimension preferably ranges from about five thousandths (0.005) of an inch to about one tenth (0.100) of an inch and, more preferably, is about fifteen thousandths (0.015) of an inch.

The valve disc 102 also preferably presents an annular o-ring gland 116 that receives the o-ring 108 (see FIG. 6). The illustrated valve disc 102 is integrally formed with the tubular body 104 at a proximal end thereof. The tubular body 104 preferably presents proximal openings 118 located adjacent the valve disc 102. The illustrated openings 118 are preferably spaced circumferentially about the tubular body 104. However, the openings 118 could be alternatively configured without departing from the scope of the present invention. The annular wall 112 and vent wall 114 cooperatively form a passage 120 that extends continuously from the openings 118 to the distal end of the tubular body 104.

As will be explained further, the valve locator 106 is used to control the position of the valve 56 relative to the conduit 52. The valve locator 106 includes a spine 122, a retainer 124, and a catch 126 that are preferably integrally formed with one another. The spine 122 extends axially along and is fixed to the rib 115 of the tubular body 104. The retainer 124 is elongated and comprises a latch that presents a proximal retainer end 128. The retainer end 128 preferably includes a sloped end surface 128*a* and a latch face 128*b* that extends proximally from the sloped end surface 128*a*. The end surface 128*a* preferably extends at an oblique angle relative to the latch face 128*b* so that the retainer 124 is shaped to readily permit releasable engagement with the catch 126. The retainer 124 extends proximally from the spine 122 to present the retainer end 128.

The illustrated catch 126 is also elongated and preferably presents a proximal catch end 130 and a base 131. The proximal catch end 130 preferably includes a shoulder 130*a*, a sloped end surface 130*b*, and a catch face 130*c* that extends longitudinally between the shoulder 130*a* and sloped end surface 130*b* (see FIGS. 4 and 5). The end surface 130*b* preferably extends at an oblique angle relative to the catch face 130*c* so that the catch 126 is shaped to readily permit releasable engagement with the retainer 124. Preferably, the catch 126 is mounted to the spine 122 along the base 131 and extends proximally from the spine 122 so as to be cantilevered. Furthermore, the catch 126 is preferably yieldably flexible in the region along the base 131 to flex between multiple positions. However, for some aspects of the present invention, the catch 126 could be alternatively mounted, e.g., to provide suitable operation of the valve locator 106. Also, biasing of the catch 126 could be provided by a biasing mechanism separate from the catch 126 rather than being provided by resilient flexing of the catch 126. The catch 126 extends proximally so that the catch end 130 is located adjacent to the retainer end 128. As will be discussed, the retainer 124 preferably comprises a latch that is configured for latching interengagement with the catch 126 when the catch 126 and retainer 124 are in a retained condition.

The illustrated valve locator 106 is preferably located along a forward-facing side of the pour spout 24. This positioning of the valve locator 106 permits convenient operation of the pour spout 24, as will be described. However, the valve locator 106 could be alternatively configured without departing from the scope of the present invention. For instance, the valve locator 106 could include multiple portions spaced circumferentially about the tubular body 104. Furthermore, in an alternative embodiment where the tubular body 104 projects proximally beyond the distal end of the conduit 52, the valve locator 106 could extend endlessly about the tubular body 104.

The illustrated valve disc 102, tubular body 104, and valve locator 106 are preferably integrally molded with one another. However, it is also within the scope of the present invention where the valve locator 106 is constructed separately from the valve disc 102 and tubular body 104. The valve disc 102, tubular body 104, and valve locator 106 are also preferably molded from a durable polymer resin material. However, it is consistent with the principles of the present invention where the valve disc 102, tubular body 104, and valve locator 106 are constructed from materials other than plastic, such as steel or other metals. Furthermore, the valve disc 102, tubular body 104, and valve locator 106 could be made by manufacturing methods other than molding.

Turning to FIGS. 3-8, the catch 126 is shiftable between retained and released conditions, preferably by yieldably flexing generally in the region of base 131 (see FIGS. 3 and 5). In the retained condition, the catch 126 is yieldably flexed so that the catch end 130 is yieldably and releasably retained under the retainer end 128, with the retainer 124 and catch 126 being in latching interengagement (see FIGS. 5 and 7). Preferably, the catch 126 is yieldably biased in the retained condition so that the catch 126 is generally urged to return to the released condition. In the released condition, the catch 126 is unflexed so that the catch end 130 is adjacent but disengaged from the retainer end 128 (see FIGS. 3 and 4). While the illustrated ends 128,130 are generally depicted as not touching one another in the released condition, it is within the scope of the present invention where the ends 128,130 could be touching each other while allowing the catch end 130 to be released for engagement with the conduit 52. Generally, the catch 126 is shifted from the released condition to the retained condition by pressing the catch 126 along an outer surface until the catch end 130 is positioned under and held by the retainer end 128 in the retained condition (see FIGS. 3 and 5). In moving the catch 126 into the retained condition, the end surfaces 128*a*,130*b* act as cam surfaces that engage one another and resiliently move the retainer 124 and catch 126 away from each other until the very tips of the retainer 124 and catch 126 slip past one another. This is followed by the retainer 124 and catch 126 snapping quickly into engagement where the faces 128*b*,130*c* contact each other. This snapping movement is preferably accompanied by an audible snapping sound that provides an audible indication that the retainer 124 and catch 126 are in latching interengagement in the retained condition.

As will be discussed, the retained condition is preferably associated with the catch 126 in an unlocked position where the catch 126 is releasably disengaged from the fluid conduit 52 and thereby allows movement of the valve 56 in a valve-opening direction. Furthermore, the released condition is preferably generally associated with the catch 126 in a locked position where the catch 126 is engaged with the locking shoulder 78*a* presented by the guide wall 78 to restrict movement of the valve 56 in the valve-opening direction (see FIGS. 3 and 5).

When installed in the conduit 52, the valve 56 is preferably slidably received within the passageway 62, with the valve locator 106 being positioned within the chamber 80. The valve disc 102 and tubular body 104 preferably present a valve diameter dimension that is less than a diameter dimension of the passageway 62. The illustrated valve 56 is preferably configured to occlude the passageway 62 when the o-ring 108 is seated onto the inner rib 72 in a closed valve position. In other words, the valve 56 is operable to slide into and out of sealing engagement with the inner rib 72. However, the valve 56 could be alternatively configured without departing from the scope of the present invention. For example, the valve disc 102 could have an alternative shape, such as a spherical shape. Also, the valve 56 could be alternatively shiftably supported and/or positioned relative to the conduit 52. For example, the valve 56 could be pivotally attached to the conduit 52, e.g., such as a butterfly valve or ball valve. Yet further, the o-ring 108 could be mounted on another part of the valve 56 so that the valve 56 is shiftable into and out of sealing engagement with the o-ring in the closed valve position. For instance, the inner surface of the conduit 52 could include an o-ring gland adjacent the inner rib 72 to receive the o-ring 108.

The valve disc 102 is preferably slidable from the closed valve position to an open valve position by shifting the valve 56 proximally in a valve opening direction. The illustrated valve body 104 preferably has a closed valve condition associated with the closed valve position where the openings 118 are not exposed from the conduit 52 to restrict fluid flow through the spout 24. Similarly, the valve body 104 preferably has an open valve condition associated with the open valve position where the openings 118 are exposed from the conduit 52 to allow fluid flow through the spout 24 (see FIG. 6). The valve disc 102 and valve body 104 are also preferably slidable together from the open valve position and open valve condition to the closed valve position and closed valve condition by shifting the valve 56 distally in a valve closing direction (see FIG. 5).

The open valve position of the valve disc 102 is preferably associated with the open valve condition of the valve body 104 so that the valve disc 102 and valve body 104 cooperatively open the valve. Also, the closed valve position of the valve disc 102 is preferably associated with the closed valve condition of the valve body 104 so that the valve disc 102 and valve body 104 cooperatively close the valve. However, it is within the ambit of the present invention where the valve disc 102 and valve body 104 are independently shiftable to independently permit fluid flow through the conduit 52.

In the open valve position, the illustrated valve 56 permits fluid within the container 22 to be poured out of the spout 24 by passing through the openings 118 and through the passage 120 (see FIG. 6). At the same time, the container 22 is vented as air flows through a vent passage 132. The illustrated vent passage 132 is preferably cooperatively defined by the vent wall 114 and the conduit 52. However, the vent passage 132 could be alternatively formed without departing from the scope of the present invention.

Preferably, the spring 110 is a coil spring and is positioned in the chamber 80. Furthermore, the spring 110 is preferably located between the base section 64 and the retainer 124. The spring 110 pushes in a distal direction against the valve locator 106 when the spring 110 is compressed. Thus, the valve spring 110 normally biases the valve 56 into engagement with the inner rib 72; that is, the spring 110 urges the valve 56 into the closed valve position. The valve 56 is consequently a normally-closed valve. Application of a force onto the valve 56 in the valve opening direction serves to shift the valve 56 out of the closed valve position if that force overcomes the bias of the spring 110. In the illustrated embodiment, such a valve-opening force is preferably applied to the distal end of the spine 122 and to an adjacent part of the longitudinal rib 115 (e.g., when the neck of receptacle R engages the spout 24). While the illustrated spring 110 is preferred for biasing the valve 56 into the closed valve position, it is within the scope of the present invention where the pour spout 24 uses an alternative biasing device (such as a biasing element integrally formed as part of the valve).

In the closed valve position, the o-ring 108 is seated against the inner rib 72. When seated against the inner rib 72, the o-ring 108 preferably restricts further movement of the valve 56 in the valve closing direction. As a result, the o-ring 108 preferably operates to restrict the valve 56 from being removed from the conduit 52 in a valve removal direction, which is preferably the same as the valve closing direction in the illustrated embodiment. In this manner, the o-ring 108 preferably operates to provide sealing engagement between the valve 56 and conduit 52 and also serves to retain the valve 56 within the conduit 52. However, for some aspects of the present invention, the o-ring 108 could be used to provide only sealing engagement between the valve 56 and conduit 52. Alternatively, the o-ring 108 could be used only for providing retention of the valve 56 within the conduit 52.

Preferably, the o-ring 108 is the sole retention element that restricts movement of the valve 56 out of the conduit 52 in the valve removal direction. It has been found that this construction provides a very simple valve design in that the illustrated conduit 52 and valve 54 each comprise unitary molded components that are slidably interconnected and retained in operable association by a single o-ring. However, for some aspects of the invention, the spout 24 could include an alternative retention device to restrict valve removal by shifting the valve in the valve removal direction beyond the closed valve position.

Preferably, the valve 56 can be removed from the conduit 52 by removing the o-ring 108 from the valve disc 102 and then sliding the remainder of the valve 56 out of the conduit 52 in the valve removal direction beyond the closed valve position. Removal of the valve 56 is preferably permitted because the valve disc 102 and tubular body 104 present a valve diameter dimension that is less than the passageway diameter dimension.

Also in the closed valve position, the catch 126 can be located relative to the conduit 52 in either the locked position or the unlocked position. In the locked position, the catch 126 releasably engages the conduit 52 to restrict valve movement in the valve-opening direction (see FIG. 3). The locked position is generally associated with the catch 126 and retainer 124 in the released condition where the catch 126 is disengaged from the retainer 124. In the unlocked position, the catch 126 is disengaged from the fluid conduit 52 to permit movement of the valve 56 in the valve-opening direction (see FIG. 5). The unlocked position is preferably generally associated with the catch 126 and retainer 124 in the retained condition.

To shift the valve 56 from the closed valve position to the open valve position, the catch 126 is shifted out of latching interengagement with the retainer 124 into the retained condition so as to be moved from the locked position to the unlocked position. Again, the catch 126 is shifted from the locked position to the unlocked position by pressing the catch 126 along outer surface 134 until the catch end 130 is snapped into engagement with and held by the retainer end 128 in the retained condition (see FIG. 5). Consequently, the catch end 130 is disengaged from the guide wall 78 and allows shifting of the valve 56 in the valve opening direction.

For pouring fluid from the container 20, the container 20 is preferably moved from an upright orientation (see FIG. 1) to an inverted pouring orientation (see FIG. 5) so that the distal end of spout 24 can be inserted into the opening of the receptacle R or another suitable container. At the same time, the valve 56 preferably remains in the closed valve position. Preferably, the spout 24 is inserted so that the spine 122 and rib 115 contact the uppermost margin of the neck that defines the receptacle opening. In the pouring orientation, the spout 24 allows venting of container 20 with ambient air and/or vapors within the container 20. In the illustrated embodiment, the mouth of the receptacle R also remains open to permit venting of receptacle R. However, it is also within the ambit of the present invention where the spout 24 is configured to engage the neck of the receptacle R to form an airtight seal between the spout 24 and receptacle R so that the container 20 recovers vapors from the receptacle as fluid is dispensed.

Turning to FIGS. 7 and 8, as the valve 56 is shifted toward the open valve position, a trip element 136 of the catch 126 presents a trip surface 138 that comes into engagement the guide wall 78 so that the catch end 130 is urged in a lateral direction. Preferably, the catch 126 is urged laterally by the trip surface 138 so that the catch end 130 and retainer end 128 become disengaged from one another and the catch 126 is thereby removed from latching interengagement with the retainer 124 (see FIG. 8). Because the catch 126 is biased into the released condition, the catch 126 snaps quickly out of engagement and toward the released condition. In this manner, the catch 126 becomes automatically released by the retainer 124 when the valve 56 is shifted into the open valve condition. This snapping movement is accompanied by an audible snapping sound that provides an audible indication that the retainer 124 and catch 126 are released from latching interengagement. Subsequently, as the valve 56 is returned to the closed valve position, the catch 126 is yieldably urged to return to the locked position.

For some aspects of the present invention, the valve 56 could be moved to one of several intermediate valve locations between the open and closed valve positions so that fluid can be poured through the conduit 52 at a lower flow rate than that associated with the open valve position. For some intermediate valve locations, the trip element 136 is not moved far enough in a proximal direction to shift the catch 126 into the released condition. In such an instance, the catch 126 would remain in the retained condition as the valve 56 is returned to the closed valve position. Furthermore, if the catch 126 continues to be retained, the catch 126 would not return itself to the locked position. That is, the catch 126 would have to be manually returned to the locked position by a user. However, the principles of the present invention are applicable where any proximal movement of the valve 56 out of the closed valve position would trigger the release of the catch 126 so that the catch 126 would automatically return itself to the locked position upon valve closure.

While the catch 126 preferably includes the trip element 136, it is also within the scope of the present invention where the guide wall 78 includes the trip element for shifting the catch end 130 out of engagement with the retainer end 128 as the valve 56 is opened. Also, for some aspects of the present invention, the spout 24 could have other alternative features so that the spout 24 returns to the locked condition after the valve is opened.

The valve 56 is assembled within the conduit 52 by placing the spring 110 in the chamber 80. The valve structure including the valve disc 102, tubular body 104, and valve locator 106 is then inserted without the o-ring 108 into the conduit 52. Insertion occurs by placing the valve disc 102 into the distal end 60 of the conduit 52 and sliding the valve structure proximally. At the same time, the longitudinal rib 115 is aligned with the slot 76. The o-ring 108 is installed onto the valve disc 102 by sliding the valve structure proximally until the valve disc 102 is exposed.

Valve disassembly is performed by initially removing the o-ring 108 from the valve disc 102. The remainder of the valve 56 can then be removed by sliding the valve structure distally out of the conduit 52.

In operation, the pour spout 24 is normally closed and is used to selectively dispense fluid from the container 22. To dispense fluid, the catch 126 is shifted into the unlocked position to allow opening of the valve 56. The spouted container is then preferably moved from an upright orientation (see FIG. 1) to an inverted orientation (see FIG. 5) so that the distal end of spout 24 can be inserted into the opening of the receptacle R or another suitable container. At the same time, the valve 56 preferably remains in the closed valve position. Preferably, the spout 24 is inserted so that the spine 122 and rib 115 contact the uppermost margin of the neck that defines the receptacle opening.

With the spout 24 contacting the neck, the container 22 is then moved in a generally downward direction relative to the receptacle R so that the valve 56 is shifted from the closed valve position to the open valve position. By shifting the valve 56 into the open valve position, the spout 24 permits a maximum rate of fluid flow through the conduit 52. Also, as the valve 56 is shifted into the open valve position, the trip element 136 engages the guide wall 78 and shifts the catch 126 into the released condition (see FIGS. 7 and 8).

Again, for some aspects of the present invention, the valve 56 could be moved to one of several intermediate locations between the open and closed valve positions where a lower rate of fluid flow is permitted through the conduit 52.

The valve 56 is returned to the closed valve position by lifting the spouted container 22 in a generally upward direction away from the receptacle R. If the valve 56 is returned to the closed valve position with the catch 126 in the released condition, the catch end 130 will automatically shift into locking engagement with the guide wall 78. If the valve 56 is returned to the closed valve position with the catch 126 in the retained condition, the catch end 130 can be manually shifted out of engagement with the retainer end 128 and into locking engagement with the guide wall 78.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A normally-closed pour spout operable to pour fluid from a container to a receptacle, said normally-closed pour spout comprising:

a fluid conduit having proximal and distal ends, with the proximal end being fluidly connectable to the container and the distal end being configured for fluid association with the receptacle, said fluid conduit forming a passageway configured to pass fluid therethrough and fluidly communicate with the container and receptacle, said fluid conduit defining a valve seat spaced along the passageway from the distal end;

a valve operably assembled with the fluid conduit so that the valve controls fluid flow through the passageway, said valve including a valve element shiftable between a valve closed position, in which the valve element engages the valve seat to occlude the passageway, and a valve open position, in which the valve element is spaced from the valve seat to permit flow through the passageway, said valve element shifting in a first direction from the closed position to the open position and in an opposite second direction from the open position to the closed position, said valve element being shiftable in the second direction beyond the closed position to disassemble the valve from the fluid conduit; and a retention device that restricts shifting of the valve element in the second direction beyond the closed position to thereby prevent disassembly of the valve from the fluid conduit, said valve further including a catch operable to selectively prevent shifting of the valve element in the first direction out of the closed position, said passageway extending along a passageway axis, said valve element being slidable along the passageway axis between the open and closed positions, said catch being shiftable into and out of a locking position, in which the catch prevents sliding of the valve element out of the closed position, said valve including a retainer configured to releasably retain the catch out of the locking position so as to permit sliding of the valve element out of the closed position, said catch being automatically released by the retainer when the valve body is in the valve open position so that the catch is permitted to return to the locking position.

2. The pour spout as claimed in claim 1, said valve element shifting in the first direction when the valve element is assembled with the fluid conduit, said retention device being removably mounted on one of the fluid conduit and the valve.

3. The pour spout as claimed in claim 2, said valve including a valve body slidably coupled to the fluid conduit, said body, catch, and valve element being integrally molded to form a single integral valve component, said fluid conduit being integrally molded to form a single integral conduit component.

4. The pour spout as claimed in claim 3, said retention device being the sole element that restricts the valve element from shifting in the second direction beyond the closed position.

5. The pour spout as claimed in claim 4; and a biasing element configured to urge the valve element into the closed position.

6. The pour spout as claimed in claim 1, said retention device including an o-ring removably mounted on one of the fluid conduit and the valve, said o-ring interengaging the valve and fluid conduit when the valve element is in the closed position.

7. The pour spout as claimed in claim 6, said valve element comprising a slidable piston movable along the passageway, said o-ring being removably mounted on and extending endlessly about the piston, with the o-ring being in sealing engagement with the valve seat when the valve element is in the closed valve position.

8. The pour spout as claimed in claim 1, said valve element comprising a slidable piston movable along the passageway, said valve including an elongated tubular body slidably received within the passageway, said valve element being fixed to the tubular body.

9. The pour spout as claimed in claim 8, said tubular body defining a fluid passage that extends distally from the valve element along the length of the tubular body.

10. The pour spout as claimed in claim 9, said tubular body and said fluid conduit cooperatively defining a vent passage that extends distally from the valve element along the length of the tubular body, said passages being substantially separated along the length of the tubular body, with the fluid passage being operable to transfer fluid from the container to the receptacle and the vent passage serving to vent vapors from the receptacle to the container.

11. The pour spout as claimed in claim 1, said retention device forming part of the valve and providing sealing engagement between the valve seat and valve element.

12. The pour spout as claimed in claim 1, said catch and retainer cooperatively presenting a retained condition, in which the catch has shifted out of the locking position and is releasably retained out of the locking position by the retainer, said catch and fluid conduit operably interengaging as the valve element is slid into the valve open position to cause the catch to be released by the retainer.

13. The pour spout as claimed in claim 12, said retainer including a latch configured for latching interengagement with the catch when the catch and retainer are in the retained condition, with said latching interengagement releasably restricting the catch from shifting back to the locking position.

14. The pour spout as claimed in claim 13, said catch presenting a trip surface that engages the fluid conduit as the valve element is slid into the valve open position and thereby remove the catch from latching interengagement with the latch.

15. The pour spout as claimed in claim 14, said catch being yieldably biased into the locking position such that the catch is yieldably urged to return to the locking position once released by the retainer.

16. A normally-closed pour spout operable to pour fluid from a container to a receptacle, said normally-closed pour spout comprising:

a fluid conduit having proximal and distal ends, with the proximal end being fluidly connectable to the container and the distal end being configured for fluid association with the receptacle, said fluid conduit forming an axially extending passageway configured to pass fluid therethrough and fluidly communicate with the container and receptacle; and a valve operably assembled with the fluid conduit so that the valve controls fluid flow through the passageway, said valve including a valve body slidably coupled to the fluid conduit for axial movement along the passageway between a valve open condition, in which fluid is permitted to flow through the passageway, and a valve closed condition, in which the passageway is occluded, said valve including a catch shiftable into and out of a locking position, in which the catch prevents sliding of the valve body out of the closed condition, said valve including a retainer configured to releasably retain the catch out of the locking position so as to permit sliding of the valve body out of the closed condition, said catch being automatically released by the retainer when the valve body is in the valve open condition so that the catch is permitted to return to the locking position.

17. The pour spout as claimed in claim 16, said catch and retainer cooperatively presenting a retained condition, in which the catch has shifted out of the locking position and is releasably retained out of the locking position by the retainer, said catch and fluid conduit operably interengaging as the valve body is slid into the valve open condition to cause the catch to be released by the retainer.

18. The pour spout as claimed in claim 17, said retainer including a latch configured for latching interengagement with the catch when the catch and retainer are in the retained condition, with said latching interengagement releasably restricting the catch from shifting back to the locking position.

19. The pour spout as claimed in claim 18, said catch presenting a trip surface that engages the fluid conduit as the valve body is slid into the valve open condition and thereby removes the catch from latching interengagement with the latch.

20. The pour spout as claimed in claim 19, said catch being yieldably biased into the locking position such that the catch is yieldably urged to return to the locking position once released by the retainer.

21. The pour spout as claimed in claim 20, said catch being resiliently flexed out of the locking position such that the catch is yieldably urged to return to the locking position once released by the retainer.

22. The pour spout as claimed in claim 21, said catch flexing in a first direction into and out of the locking position, said catch being resiliently flexed in a second direction when removed from latching interengagement with the latch, said first and second directions being oblique relative to one another.

23. The pour spout as claimed in claim 22, said catch including a shoulder that engages the fluid conduit when valve body is in the closed position and the catch is in the locked position.

24. The pour spout as claimed in claim 18, said catch and retainer being configured to provide audible indications when the catch is placed into and removed from latching interengagement with the retainer.

25. The pour spout as claimed in claim 16, said fluid conduit presenting an exterior axial slot that is formed exterior to the passageway, with the slot slidably receiving the retainer and the catch therein.

26. The normally-closed pour spout as claimed in claim 25, said catch and retainer cooperatively presenting a retained condition, in which the catch has shifted out of the locking position and is releasably retained out of the locking position by the retainer, said fluid conduit including a conduit wall and an auxiliary wall, said conduit wall forming the passageway, said auxiliary wall projecting from the conduit wall outside the passageway and defining the exterior axial slot, one of said auxiliary wall and said catch including a trip element, said trip element engaging the other of the auxiliary wall and the catch as the valve body slides from the closed condition to thereby remove the catch and retainer from the retained condition.

* * * * *